US006679642B1

(12) United States Patent
Dillingham et al.

(10) Patent No.: US 6,679,642 B1
(45) Date of Patent: Jan. 20, 2004

(54) TOOTHBRUSH WITH RESERVOIR

(76) Inventors: John B. Dillingham, 1325 Dylan Cir., Henderson, KY (US) 42420-5339; Brenda W. Dillingham, 1325 Dylan Cir., Henderson, KY (US) 42420-5339

( * ) Notice: Subject to any disclaimer, the term of this patent is extended or adjusted under 35 U.S.C. 154(b) by 0 days.

(21) Appl. No.: 10/195,705

(22) Filed: Jul. 15, 2002

(51) Int. Cl.[7] ..... B43M 11/06

(52) U.S. Cl. ..... 401/184; 401/134; 401/278

(58) Field of Search ..... 401/183, 184, 401/185, 186, 289, 270, 278, 132, 133, 134

(56) References Cited

U.S. PATENT DOCUMENTS

| | | | | |
|---|---|---|---|---|
| 383,609 | A | | 5/1888 | Baker et al. |
| 416,685 | A | | 12/1889 | Nichols |
| 423,784 | A | | 3/1890 | Loback |
| 433,814 | A | | 8/1890 | Otto |
| 444,303 | A | | 1/1891 | Ostrom et al. |
| 490,831 | A | | 1/1893 | Lohers |
| 757,907 | A | | 4/1904 | Fritz |
| 814,235 | A | * | 3/1906 | Rosenstein ..... 401/185 |
| 1,605,651 | A | | 11/1926 | Doi |
| 2,097,010 | A | | 10/1937 | Arnegger |
| 2,416,684 | A | | 3/1947 | Fischer |
| 3,734,106 | A | * | 5/1973 | Zimmerman ..... 132/79 |
| 4,049,354 | A | * | 9/1977 | O'Rourke ..... 401/134 |
| 4,429,434 | A | | 2/1984 | Sung-shan |
| 4,527,574 | A | * | 7/1985 | Manfredi ..... 132/84 B |
| 4,620,528 | A | | 11/1986 | Arraval |
| 5,369,835 | A | | 12/1994 | Clarke |
| 5,846,010 | A | | 12/1998 | Barbalich |
| 5,850,659 | A | | 12/1998 | Butler et al. |
| 5,915,868 | A | | 6/1999 | Frazell |
| 5,918,995 | A | | 7/1999 | Puurunen |
| 5,921,692 | A | * | 7/1999 | Weber ..... 401/119 |
| 6,076,223 | A | | 6/2000 | Dair et al. |
| 6,108,869 | A | | 8/2000 | Meessmann et al. |
| 6,179,503 | B1 | | 1/2001 | Taghavi-Khanghah |
| 6,203,320 | B1 | | 3/2001 | Williams et al. |
| 6,220,772 | B1 | | 4/2001 | Taylor |
| 6,238,118 | B1 | | 5/2001 | Tryon |
| 6,241,412 | B1 | | 6/2001 | Spies et al. |
| 6,257,791 | B1 | | 7/2001 | Scamard |

* cited by examiner

*Primary Examiner*—David J. Walczak
(74) *Attorney, Agent, or Firm*—Carrithers Law Office; David W. Carrithers

(57) ABSTRACT

A toothbrush having a water reservoir in the handle and squeezable to force water therefrom through a plurality of spaced apart orifices located at the base of bristles that project from the head of the brush.

17 Claims, 6 Drawing Sheets

TOOTHBRUSH WITH RESERVOIR

BACKGROUND OF THE INVENTION

1. Technical Field

This invention relates generally to dental hygiene and more particularly to a toothbrush having a reservoir for water, or other liquid cleanser, in which the reservoir communicates via fluid flow passages with the brush end of the toothbrush and operable for dispensing the cleansing fluid therefrom.

2. Description of the Prior Art

A supply of water, or other cleansing fluid, is essential for properly cleaning ones teeth. It is common practice to turn on the water faucet and let the water run while brushing to rinse off the brush and also to convey water, via the brush, to the mouth for cleaning. Children, and others that spend a lot of time brushing their teeth, can leave the faucet running for a long time for each brushing. This wastes water and is of considerable concern particularly in places where there are water shortages or a lack of a sufficient supply of potable water. There is not always a safe and clean supply of water available for example when traveling in countries where the tap water in unsafe for human use. Also when camping or hiking, water conservation and/or the absence of water and/or whether or not the water is safe to use can be of concern and thus it would be comforting to know that one has their own water supply, or other suitable cleansing fluid, available and safe to use.

In addition to the forgoing often difficulties are encountered by an elderly or disabled person, particularly when bedridden, when trying to clean their own teeth or when such task is undertaken by a care giver. Today it is common for the elderly, because of good dental hygiene practice throughout their lives, to have their own natural set of teeth and therefor cleaning in situ is required.

Furthermore, service man assigned to armed service units in the jungle or desert areas often find potable water scarce.

SUMMARY OF THE INVENTION

A principal object of the present invention is to provide a toothbrush having means for dispensing a cleansing fluid from the head end of the brush.

A further principal object of the present invention is to provide a toothbrush with its own supply of a cleansing fluid that can be dispensed when needed and with ease from the head of the brush.

A further principal object of the present invention is to provide a toothbrush incorporating therein a reservoir for a cleansing fluid and means whereby the cleansing fluid can be readily dispensed from the head of the toothbrush by applying hand pressure to the toothbrush handle.

A further object of the present invention is to provide a toothbrush with a water reservoir so that there is no need to turn on the water faucet until the reservoir needs refilling.

A further object of the present invention is to provide a toothbrush with a carry along supply of cleansing fluid that one knows is safe to use while traveling, hiking or camping.

It is another object of the present invention to provide a valve in the handle to regulate the flow of water to the bristles of the brush.

It is another object of the present invention to provide an adapter for attaching the handle of the brush to a supply of water such as a bottle or cartridge.

These and other objects are accomplished by a toothbrush provided in accordance with the present invention in which the toothbrush handle has a fluid confining chamber therein defined at least in part by a flexible wall for varying the volume of the chamber by applying hand pressure to the handle and a fluid flow passageway from the chamber to outlet orifices in the head of the brush adjacent the base end of the bristles that project from the head.

A preferred embodiment provides a toothbrush including a handle having a fluid confining chamber providing a reservoir defined at least in part by a flexible wall for use in varying the volume of the reservoir by applying hand pressure to the handle. A head connected to the handle and having a plurality of bristles projecting therefrom is provided with a plurality of spaced apart orifices in the head disposed at a position adjacent a base end of the bristles. Passageway means connects the reservoir in fluid flow relation with the orifices. Optionally a screw or friction fit connection may be used as an adapter to connect the distal end of the handle to a portable water source such as a bottle of water or cartridge containing same. It is anticipated that a plastic bag containing water could be inserted into the cartridge. A means for piercing the bag or cartridge of water such as a removable hollow lance may be incorporated with the removable water source adapter.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
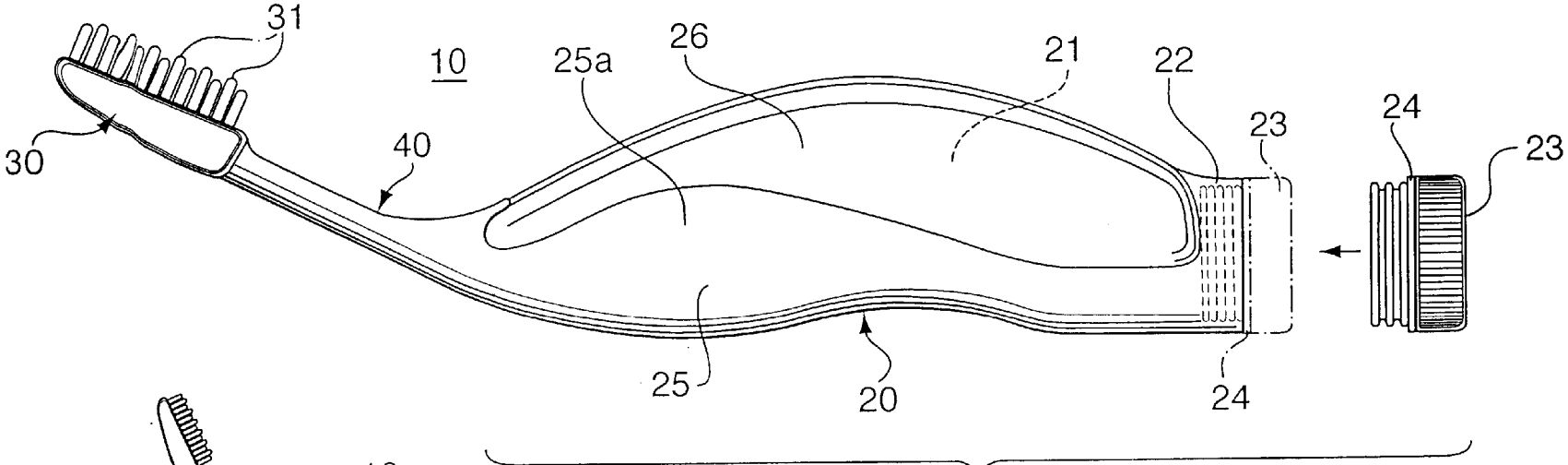
FIG. 1 is a side elevational view of one embodiment of toothbrush provided in accordance with the present invention.

Referring to the drawings there is illustrated a toothbrush 10 having a handle 20 and a brush head 30 interconnected by a stem 40 interposed there between. The stem is preferably curved as seen in FIG. 1 but if desired it maybe straight. The handle in general is of an ergonomic design to fit comfortably in the palm of ones hand and has a reservoir 21 therein for holding a supply of water or other tooth cleansing fluid.

The brush head 30 has a cluster 31 of bristles surrounding each of a plurality of spaced apart orifices 32 arranged by way of example geometrically in 5 rows in the longitudinal direction of the handle and in 13 rows transverse thereto. The number of rows are purely by way of example and maybe varied to suit ones desires for performance of the toothbrush. The array of orifices maybe geometrically arranged or they maybe randomly arranged on the surface of the brush head. The outer terminal end of each cluster of bristles is preferably contoured for example suitably rounded as indicated at 33 to provide good tooth contact and adjacently disposed clusters preferably differ in height from one another again for the purpose of providing good tooth contact. The head has a cavity 34 therein that serves as a manifold and each orifice is in fluid flow communication with such manifold.

Figure 3:
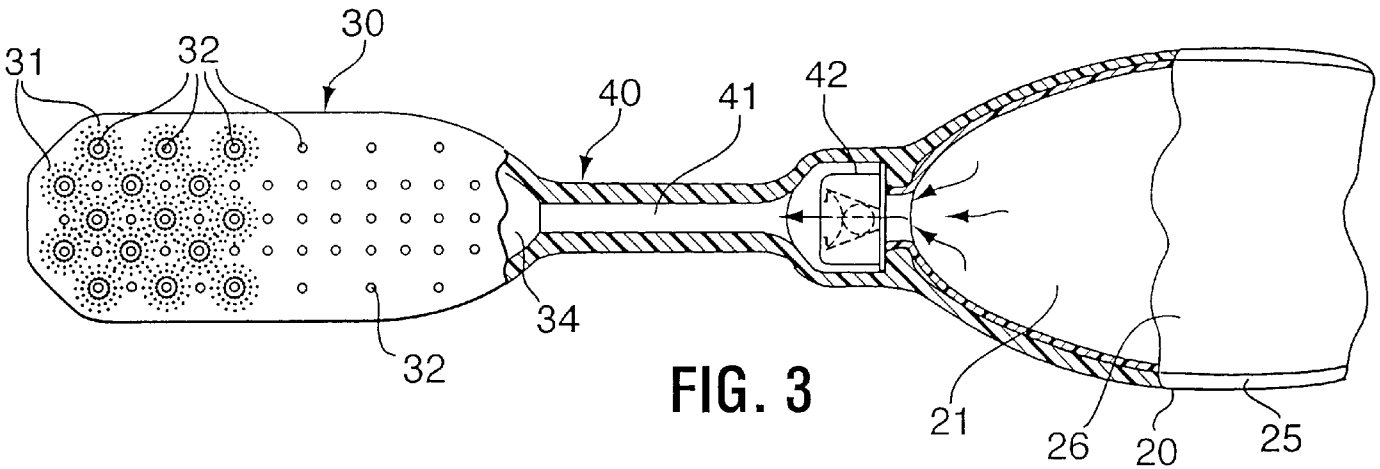
FIG. 3 is a plan view of the brush end portion of the toothbrush shown in FIG. 2.

The water reservoir 21 is in fluid flow communication with the orifices via a passageway 41 through the neck 40 and the manifold 34 in the brush head. A one way flow control valve 42 is located between the reservoir and the orifices and maybe located in the passage way 41 or at the juncture of the reservoir and the passage way as illustrated in FIG. 3. The valve maybe retained in position by being in a press friction fit relation in an enlargement at the commencement of the passage way and inserted there into through an opening 22 into the reservoir. The opening 22 is preferably located at the free outer end of the handle and circumscribed by screw threads for removably receiving a threaded cap 23. A washer 24 is interposed between the cap and the handle to prevent fluid escaping from the reservoir.

Alternatively, the handle maybe removably attached to the neck and joined thereto by friction fit or, and more securely, by screw threads. The valve in such instance can be interposed between the two sections and operatively disposed in the passageway to prevent backflow into the reservoir.

The handle 20 has a rigid portion 25 suitably designed and including side wing portions 25A for a comfortable hand grip when using the toothbrush to brush ones teeth and a flexible portion 26. The flexible portion allows the user to vary the volume of the reservoir decreasing such volume by squeezing on the handle and thereby forcing liquid from the reservoir through the passageway into the manifold and out through the orifices. The one way valve 42 prevents contaminants from returning to the reservoir from the brush head and thereby ensures one having a clean supply of cleansing fluid at all times. The flexible portion 26 maybe a plastics material or rubber and preferably is self sustaining in shape whether the reservoir is filled or not but soft enough that a gently squeeze will expel water from the reservoir through the orifices in the head when the reservoir is filled.

The handle rigid portion 25 is cup shaped with the bottom of such cup providing a support base for the reservoir. The reservoir maybe provided by a covering overlying the rigid portion of the handle or alternatively it maybe a bladder type unit separately provided and fitted into the cup portion and secured in any convenient manner e.g. by hook and loop cooperating fasteners. In either instance it is preferably of a material that exhibits a soft to touch feel. In the case of a bladder it would obviously provided with a spigot attachable by a leak proof connection in fluid flow relationship with the passage 41.

Figure 4:
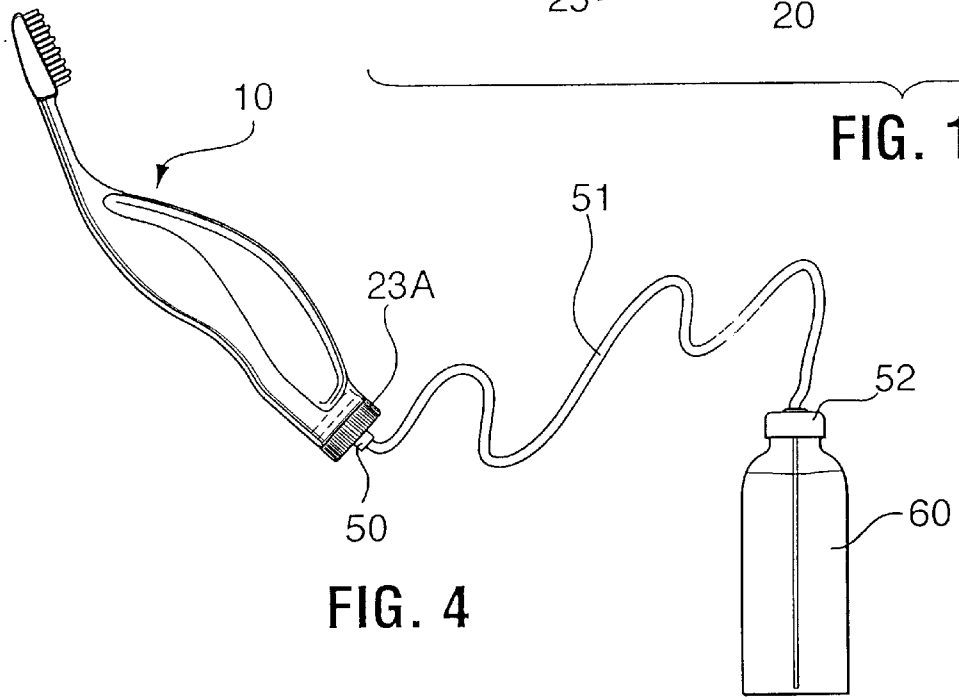
FIG. 4 is an oblique view illustrating a further embodiment that includes an attachment connectable to a separate supply of a cleansing fluid.
Figure 2:
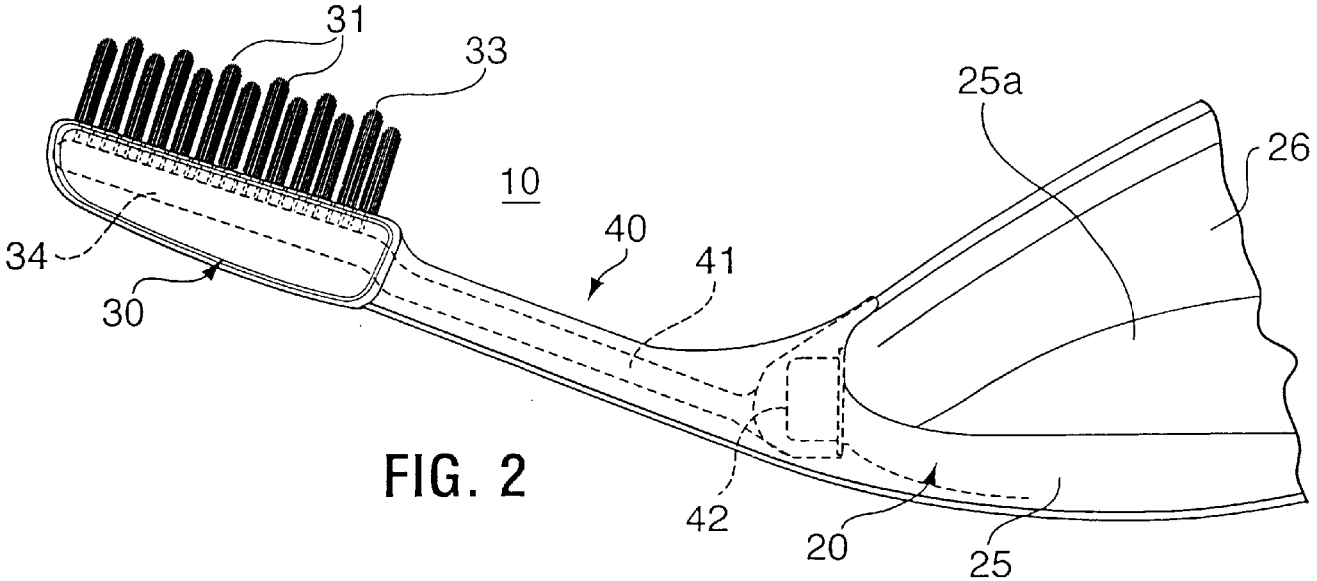
FIG. 2 is a side elevational view of a portion of the head end of the toothbrush shown in FIG. 1 but on a larger scale.
Figure 5:
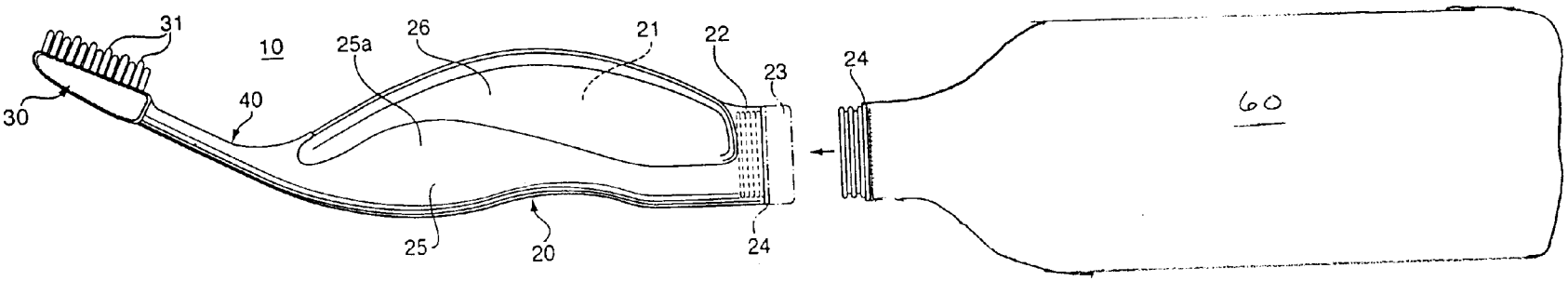
FIG. 5 is a side elevational view of the embodiment of FIG. 1 including a water bottle having a threaded nozzle for threadably engaging the adapter in the distal end of the toothbrush handle.

In the embodiment illustrated in FIG. 4, the cap 23 previously described is replaced by a cap designated 23A which has a means 50 for connecting thereto one end of a flexible conduit 51 the other end of which connects via a coupling 52 to a bottle 60 containing water or other suitable cleansing fluid for ones teeth as best shown in FIG. 5 as a threaded coupling. In this embodiment, the reservoir may be smaller in volume than in the embodiment of FIGS. 1 to 3 and if desired it could even be eliminated if the bottle was made of a flexible or the like material so that it could be squeezed and thus become the sole source of supply of cleansing fluid. Moreover, the bottle could be used to refill the toothbrush handle, removed before use, and resealed or recapped and any remaining liquid saved for use at a later time.

Figure 6:
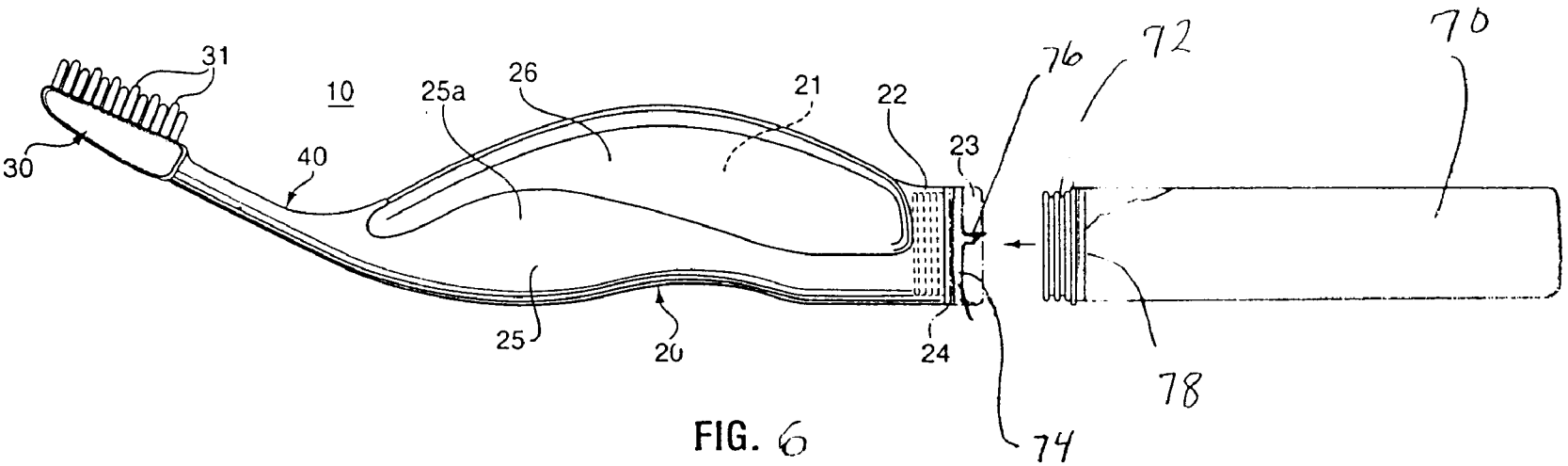
FIG. 6 is a side elevational view of the embodiment of FIG. 1 including a water cartridge housing having a threaded nozzle for threadably engaging the adapter in the distal end of the toothbrush handle including a disc with a hollow lance extending therefrom for piecing a membrane releasing the water from the cartridge housing upon threadably receiving same.

As shown in FIG. 6, the toothbrush includes a water cartridge housing 70 having a threaded nozzle 72 for threadably engaging the internal threads in the adapter in the distal end of the toothbrush handle. The assembly includes a means for sealing and piercing such as a washer or disc 74 having a hollow lance 76 extending therefrom for piecing an end wall 78 of the cartridge housing which may be comprised of a thin plastic film or a membrane (such as composed of aluminum foil, plastic film, etc.) which releases the water/liquid from the cartridge housing 70 upon threadably receiving same puncturing the end wall 78 with the lance 76. As shown the water cartridge housing 70 is cylindrical; however, it is contemplated that the housing could be of any ergonomical shape or fanciful design.

Figure 7:
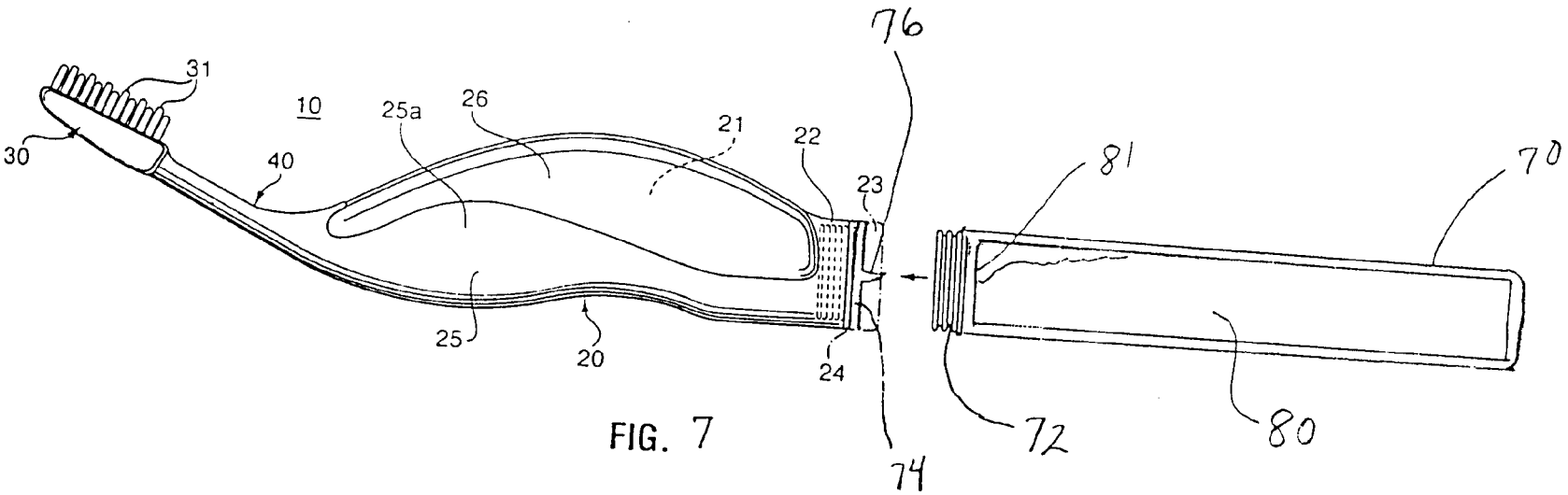
FIG. 7 is a side elevational view of the embodiment of FIG. 1 including a water cartridge for insertion into a cylindrical water cartridge housing having a threaded nozzle for threadably engaging the adapter in the distal end of the toothbrush handle including a disc with a hollow lance extending therefrom for piecing the end of the cartridge releasing the water from the cartridge upon threadably receiving the cartridge housing.

As illustrated in FIG. 7, the toothbrush includes a cartridge housing 70 having a threaded nozzle 72 for threadably engaging the internal threads in the adapter in the distal end of the toothbrush handle. The assembly includes a plastic disposable cartridge 80 having a pierceable end wall and means for sealing the periphery of the cartridge against the adapter of the handle and means for piercing the cartridge 80. The means for sealing and piercing an end wall 81 of the cartridge 80 may be a washer or disc 74 having a hollow lance 76 extending therefrom for piecing the end wall of the cartridge 80. The end wall 81 of the cartridge 80 may also be formed or composed of aluminum foil, plastic film, etc.) so that piercing same releases the water from the cartridge 80 upon threadably engaging the cartridge housing 70 to the handle adapter.

Figure 8:
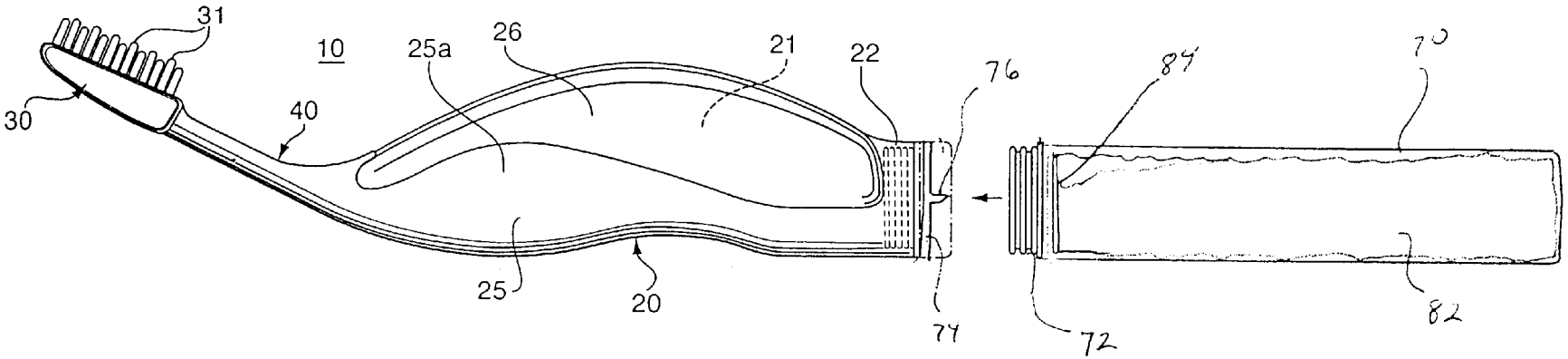
FIG. 8 is a side elevational view of the embodiment of FIG. 1 including a water bag for insertion into a cylindrical cartridge housing having a threaded nozzle for threadably engaging the adapter in the distal end of the toothbrush handle including a disc with a hollow lance extending therefrom for piecing the end of the bag releasing the water from the cartridge upon threadably receiving the cartridge housing piercing the water bag therein.

FIG. 8 shows the toothbrush which includes a cartridge housing 70 having a threaded nozzle 72 for threadably engaging the internal threads in the adapter in the distal end of the toothbrush handle. The assembly includes a plastic disposable water bag 82 for insertion into the cartridge housing 70. The water bag 82 has a pierceable end wall and means for sealing the periphery of the water bag 82 against the adapter of the handle and means for piercing the water bag 82. The means for sealing and piercing the water bag 82 may be a washer or disc 74 having a hollow lance 76 extending therefrom for piecing the end wall of the water bag 82. An end wall 84 or fill port of the water bag 82 may also be formed of or composed of a ring or washer formed of aluminum foil, plastic film, etc.), which upon piercing releases the water from the water bag 82 upon the handle adapter threadably receiving the cartridge housing 70.

The cartridge housing 70 and/or any of the reservoir supply devices attachable to the handle of the toothbrush can be used connected to the toothbrush; however, it is anticipated that the reservoir supply devices such as the cartridge or bag within the cartridge housing or the cartridge housing itself would normally be disconnected from the toothbrush handle prior to using the toothbrush.

Alternatively, the tooth brush reservoir could be used to draw water from the bottle in which case the bottle connection could be vented and the tube 51 (or extension thereof) project into the water in the bottle as illustrated in FIG. 4. In such an embodiment it maybe necessary to have a back flow preventing valve in the conduit 51 at a position near the bottle.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. A toothbrush, comprising:

a handle including a fluid reservoir therein, said fluid reservoir comprising a rigid portion and a flexible portion which is compressible upon exertion of pressure thereon for varying the volume of said fluid within said reservoir by the application of hand pressure to said flexible portion of said handle;

a head extending from a proximate end of said handle, said head including a plurality of bristles projecting therefrom and including at least one outlet orifice for dispensing a fluid therefrom in fluid communication with said bristles;

a fluid flow passageway connecting said fluid reservoir in said handle with said at least one outlet orifice in said head for dispensing said fluid therefrom;

a one way flow control valve disposed within said toothbrush between said reservoir in said handle and said head;

said handle including a distal end having an opening therein for receiving fluid and being in fluid communication with said fluid reservoir;

a removable means for sealing said opening of said distal end of said handle;

means for holding said removable means to said distal end of said handle;

a fluid container containing a fluid and including means for removably connecting to said means for holding said removable means to said distal end of said handle providing fluid communication with said handle, said fluid container extending from said distal end of said handle upon mounting thereto;

and means for piercing said fluid container upon mounting said fluid container to said handle, thereby releasing fluid from said fluid container.

2. The toothbrush of claim 1, further including a neck disposed between said handle and said head, said neck including a passageway for flow of a fluid from said reservoir in said handle to said head.

3. The toothbrush of claim 1, wherein said head includes a cavity serving as a manifold to dispense said fluid through a plurality of outlet orifices.

4. The toothbrush of claim 1, wherein said outlet orifices are disposed adjacent a base end of said bristles.

5. The toothbrush of claim 1, wherein said fluid container is flexible.

6. The toothbrush of claim 1, wherein said fluid container is selected from the group consisting of a flexible bottle, a flexible cartridge, and a flexible bag disposed within a cartridge or container.

7. The toothbrush of claim 1, wherein said fluid is water.

8. The toothbrush of claim 1, wherein said means for holding said removable means to said distal end of said handle comprises a plurality of threads formed on a surface of said distal end of said handle.

9. The toothbrush of claim 8, wherein said removable means for sealing said opening of said distal end of said handle comprises a cap having threads for threadably engaging said plurality of threads disposed on a mating surface- of said distal end of said handle.

10. The toothbrush of claim 8, wherein said fluid container includes a threaded nozzle for threadably engaging said plurality of threads disposed on a mating surface of said distal end of said handle.

11. The toothbrush of claim 1, wherein said means for holding said distal end of said handle to said distal end of said container providing fluid flow there between comprises an adapter disposed there between.

12. The toothbrush of claim 11, wherein said adapter is positioned at the distal end of said handle.

13. The toothbrush of claim 12, wherein said adapter includes a plurality of threads for threadably engaging said container wherein said container has a nozzle including a threaded portion in cooperative engagement with said adapter.

14. The toothbrush of claim 1, wherein said means for piercing is a lance.

15. The toothbrush of claim 14, wherein said lance is hollow.

16. The toothbrush of claim 14, wherein said lance is removable.

17. The toothbrush of claim 14, wherein said lance is a removable disc including a hollow lance for disposing between said distal end of said handle and said fluid container, whereby mounting said fluid container to said handle pierces said fluid container releasing fluid therefrom which flows through said handle to said reservoir and through said fluid flow passageway to said at least one outlet orifice.

* * * * *